US005634529A

United States Patent [19]

Nguyen et al.

[11] Patent Number: 5,634,529

[45] Date of Patent: Jun. 3, 1997

[54] FOLDING RAIL FOR A LIFTING TRUCK

[75] Inventors: Anh M. Nguyen, Landisville; James Ridings, Glenmoore, both of Pa.

[73] Assignee: Strato-Lift, Inc., Morgantown, Pa.

[21] Appl. No.: 263,565

[22] Filed: Jun. 22, 1994

[51] Int. Cl.[6] ..... E06C 5/06

[52] U.S. Cl. ..... 182/113; 182/63

[58] Field of Search ..... 182/2, 63, 113, 182/223

[56] References Cited

U.S. PATENT DOCUMENTS

| | | | |
|---|---|---|---|
| 984,063 | 2/1911 | Berg | 182/113 |
| 3,072,215 | 1/1963 | Rush | 182/113 X |
| 4,371,056 | 2/1983 | Anglade | 182/113 X |
| 4,749,060 | 6/1988 | Vandelinde | 182/113 X |
| 4,759,437 | 7/1988 | Bevins | 182/113 X |

*Primary Examiner*—Alvin C. Chin-Shue

*Attorney, Agent, or Firm*—Dann, Dorfman, Herrell and Skillman, P.C.

[57] ABSTRACT

A lifting truck is provided with a folding rail assembly for confining workers to an elevated platform. The folding rail assembly includes a plurality of link members pivotally connected relative to the platform and to a protective railing structure. The link members permit movement of the protective railing structure between a lowered position and an elevated position relative to the platform. One or more latch members are pivotally connected with respective link members for preventing movement of the railing from the elevated position. The latch members are configured to allow the railing to be lifted directly to the elevated position. The latch members comprise handles for exerting an opposing force against the bias of a spring for releasing the latch members to permit the railing to be lowered after use.

10 Claims, 8 Drawing Sheets

FOLDING RAIL FOR A LIFTING TRUCK

BACKGROUND

In the use of elevated platforms for supporting people and/or cargo, it is generally desirable to provide a protective enclosure for confining the people and/or cargo on the supporting surface of the platform. Platform lifting machines, such as mobile lift mechanisms, having platforms which are vertically elevated, are known in the art and are provided with railing structures to confine the people on the platform. It is desirable for such railings to be positioned at a sufficient height above the edges of the platform to inhibit people from falling from the platform. It is also desirable for the railing to be sufficiently high and rigid to withstand and restrain outward forces applied to the railing, for example, when people lean against the railing.

Platform lifting machines are used at a wide variety of applications in buildings, particularly office and government buildings. The platform lifting machines are frequently transported to different areas in the buildings through door ways having limited vertical clearance or from floor to floor on freight elevators having limited access openings. When moving the lift mechanism from one area to another, the height of the platform lifting machine must be less than the vertical clearance of the door frame or other opening between areas. The presence of a railing or other protective structure above the perimeter of the platform contributes significantly to the overall height of the lifting machine. In order to provide the ability to reduce the height of the platform lifting machine for the purpose of passing through doorways and other limited access openings, lifting machines have been designed with various types of collapsible or removable railings, such as inwardly or outwardly folding railings, telescoping railings, or completely removable railings.

All of the prior art attempts to reduce the height of lifting machines have not produced satisfactory solutions and all have possessed distinct disadvantages. For example, in the use of removable railings, workers using the lifting machine may neglect to replace the railing on the platform or may improperly fit parts together prior to using the lift machine. Railings which fold inwardly or outwardly relative to the platform area have been found to be awkward to use by persons standing upon the platform. Additionally, folding railings and telescoping railings have relied upon removable fasteners, such as removable lock pins, in order to secure the railings in a desired position. As in the use of removable railings, workers using such lifting machines, may neglect to replace the locking pins, thereby being exposed to the risk of injury because the railing is not secure to prevent falling from the platform.

It would be desirable to provide a protective railing structure for platform lifting machines that would be easy to reduce in height when desired and would be conducive to easy and safe replacement to its protective position when the platform is in use. It would also be desirable to provide a protective railing structure that would be particularly resistant to failure when receiving the force of a person falling against the railing while using the platform.

SUMMARY

In accordance with the present invention, an elevated platform apparatus, such as a mobile platform lifting mechanism, is provided with a folding rail arrangement for allowing the height of the platform lifting mechanism to be reduced without compromising the safety provided by a protective railing structure. The folding rail arrangement includes a plurality of link members pivotally connected relative to the platform and pivotally connected with a railing assembly. The link members permit movement between the railing assembly and the platform for moving the railing assembly between lowered position and an elevated position relative to the platform. One or more latch members are connected with the link members in order to secure the railing assembly in the elevated position. The latch members are guided between the elevated and lowered positions of the railing assembly by locking members, which are received in guide slots in the latch members. As the railing assembly is moved to its elevated position, the link members are rotated and the latch members are guided to their locking position with the locking members to hold the railing assembly locked in the elevated position. A spring is connected with the latching member to urge the latching member into its locked engagement with the locking member. A lever is provided on the latch member to facilitate ease of disengagement of the latch member from the locking member for moving the railing assembly to its lowered position.

BRIEF DESCRIPTION OF THE FIGURES

The foregoing summary, as well as the following detailed description of the preferred embodiments of the invention, will be better understood when read in conjunction with the appended drawings in which.

DETAILED DESCRIPTION

Figure 1:
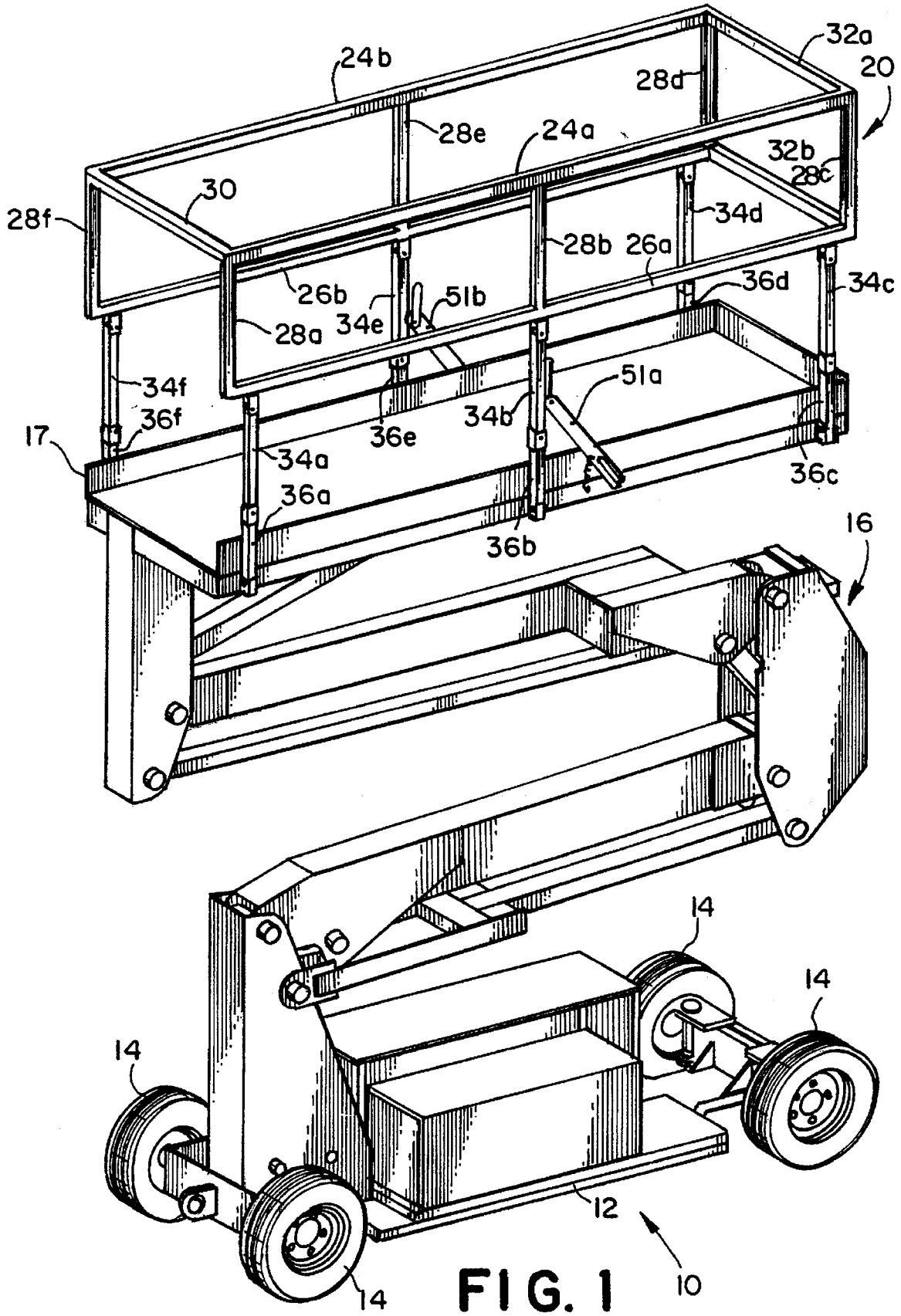
FIG. 1 is a perspective view of a mobile platform lifting machine having an adjustable rail assembly in accordance with the invention.

Referring now to FIG. 1, there is shown a platform lifting machine generally designated 10. The lifting machine 10 includes a base or chassis 12, which provides mobility for the machine. Wheels 14 are attached to the chassis 12, and at least one of the wheels is driven by a suitable motor (not shown), for providing the ability to easily move the machine 10 from one location to another. A lifting mechanism generally designated 16 is mounted on the chassis 12 for raising and lowering a platform or work station 18 attached to one end of the lifting mechanism 16. The lifting mechanism 16 can be an articulated boom as shown in FIG. 1 or can be provided by one of many types of known lifting mechanisms, such as a telescoping boom. One type of lifting mechanism is shown and described in U.S. Pat. No. 4,953,666. In other embodiments, the platform 18 may be elevated above the ground by being suspended by any suitable means, such as by ropes anchored from above the ground, elevated booms and the like.

A protective structure, generally designated as railing assembly 20, is positioned above the perimeter of the platform for protecting occupants and/or cargo on the platform from the risk of falling off of the platform. The railing assembly 20 preferably includes an upper side rail 24*a* and a lower side rail 26*a*. The upper and lower side rails are rigidly connected together in parallel arrangement by vertical struts 28*a*, 28*b*, and 28*c*. The side rails 24*a* and 26*a* serve to restrain people from falling off of one side of the platform 18. Similarly, an upper side rail 24*b* and a lower side rail 26*b* are connected together by vertical struts 28*d*, 28*e*, and 28*f* on the opposite side of the platform, as shown in FIG. 1.

At the front end of the railing assembly 20, the upper side rails 24*a* and 24*b* are preferably connected by an upper end rail 32*a*. Similarly, the front ends of lower side rails 26*a* and 26*b* are connected by a lower end rail 32*b*. At the rear end of the railing assembly 20, upper side rails 24*a* and 24*b* are preferably connected by an upper end rail 30. A single end rail 30 is employed at the rear end of the railing assembly 20 to facilitate an opening therebeneath to climb aboard the platform, particularly when the railing assembly is positioned as shown in FIG. 1.

In alternative embodiments, the ends of the railing assembly may include gates, chains, or other means (not shown) for selectively allowing or preventing access to the platform 18. In still other embodiments, the ends of the railing assembly may be open, so that the railing assembly consists essentially of two separated protective railing structures above the respective sides of the platform.

The railing assembly 20 is connected to the platform by means of a plurality of adjustable link members designated 34*a–f*, which are each pivotally connected at one end to the underside of the railing assembly 20. The links 34*a–f* are pivotally connected at their other ends with respective upstanding posts 36*a–f*, which are rigidly secured to the sides of platform 18, as shown in FIG. 1. The railing assembly is preferably supported at a sufficient height or elevated position above the perimeter of the platform, so that the upper side rails 24*a* and 26*a* are above the general waist level of persons who may work in a standing position on the platform 18. Such a height is desirable to inhibit or prevent people from falling over the top of the railing assembly as they stand and work on the platform. Most specifically, the upper side rails are preferably supported at a height of between 40 inches and 44 inches above the surface of the platform in accordance with the ANSI/OSHA standards relating to these types of elevated platforms. The lower side rails are positioned about halfway between the platform and the upper side rails at a height of between 20 and 22 inches above the platform, when the railing assembly is in its elevated position.

A side panel or skirt 17 is preferably attached to the perimeter of the platform 18. The side panel 17 extends vertically several inches from the periphery of the sides and one end of the platform 18 to prevent a person's foot or cargo from slipping off of the platform.

Figure 2:
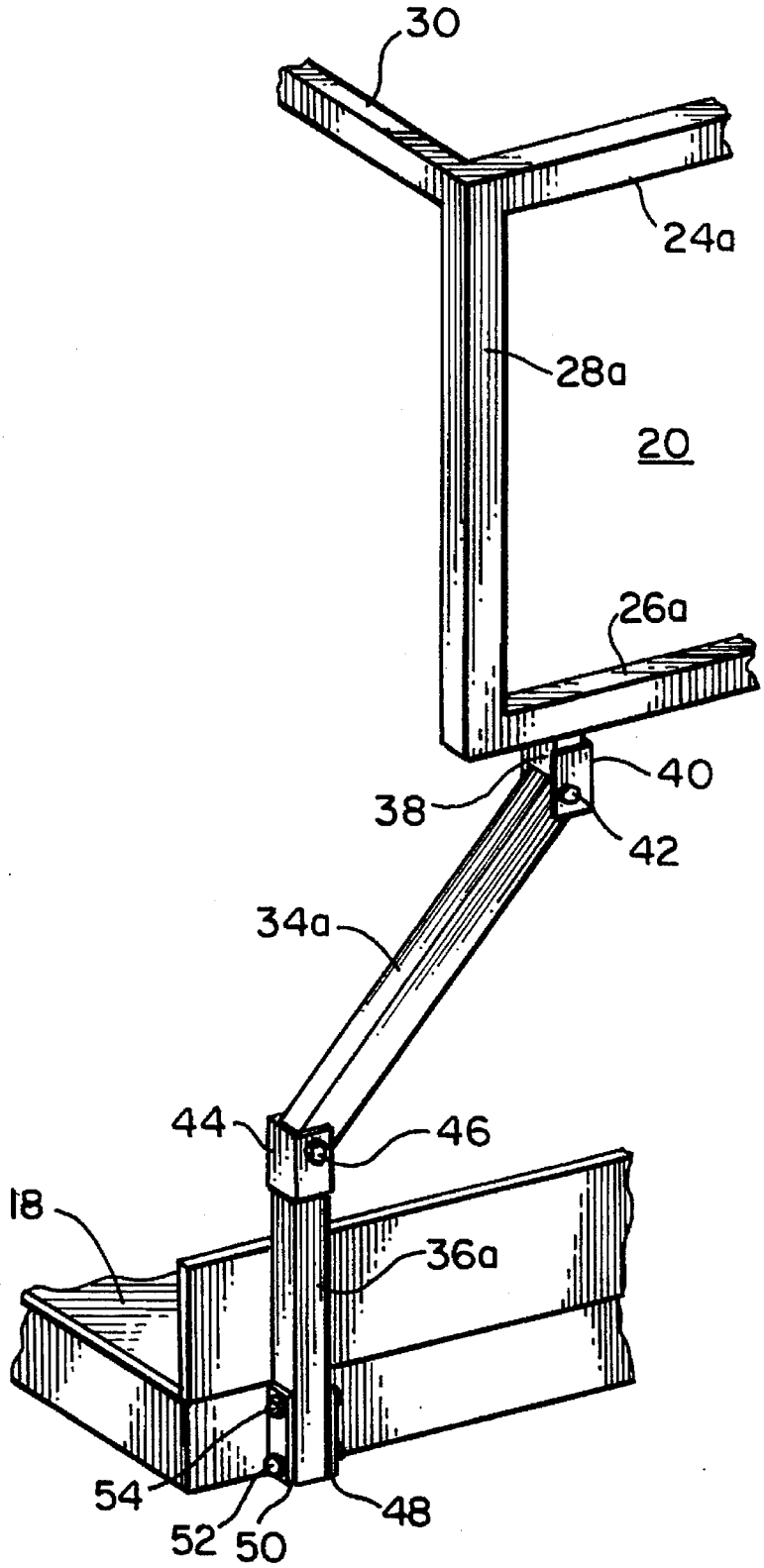
FIG. 2 is a perspective view of a portion of the adjustable rail assembly with parts broken away from the platform and railing assembly.

An example of the adjustment or movement of the link members is shown in greater detail in FIG. 2. A connecting bracket 38 is attached to the underside of the lower side rail 26*a*. The bracket 38 is welded or otherwise attached to the side rail and extends downwardly. A pivotal connection is formed between the bracket 38 and one end of link 34*a*, such as by bolt 42 that is secured to the bracket 38 and extends through one end of the link arm 34*a*. The end of the link arm 34*a* that is secured to the bracket 38 may be rounded or beveled to facilitate unrestricted rotation of the link arm 34*a* about the pivot 42. The bracket 38 permits the link arm 34*a* to be rotated until the link 34*a* is substantially perpendicular to the lower side rail 26*a*.

As can be appreciated, the plane of rotation of the link 34*a* is substantially perpendicular to any outward or inward forces that would be applied to the side rails 24*a* or 26*a* by, for example, a person leaning against or falling into the railing assembly 20. Thus, the pivotal joint between the link 34*a*and the railing assembly is relatively rigid with respect to such forces.

The opposite end of the link 34*a*is secured by pivot pin 46 to a bracket 44 attached to the upper end of stationary post 36*a*, which is attached to the platform 18. The pivot connection allows the link 34*a*to rotate until the link 34*a*is relatively parallel to the surface of the platform 18. As can be seen in FIGS. 1 and 2, the plane of rotation of the link 34*a* about pivot 46 is perpendicular to forces that may be applied to the side rails 24*a* and 26*a* by a person leaning or falling into them. Also, as can be appreciated, the lower pivot for the link 34*a* remains stationary relative to the platform 18 as the railing assembly 20 is elevated or lowered. Additionally, the upper pivot 42 is moved relative to the platform along an arc defined by the length of the link 34*a*.

In alternative embodiments, the pivotal connections between the link 34 and the bracket 38 or between the link 34 and post 36 can be made by other suitable attachment means, such as is well known in the art. The pivotal connection merely needs to allow suitable articulation of the connection between the railing assembly 20 and the platform 18.

Figure 3A:
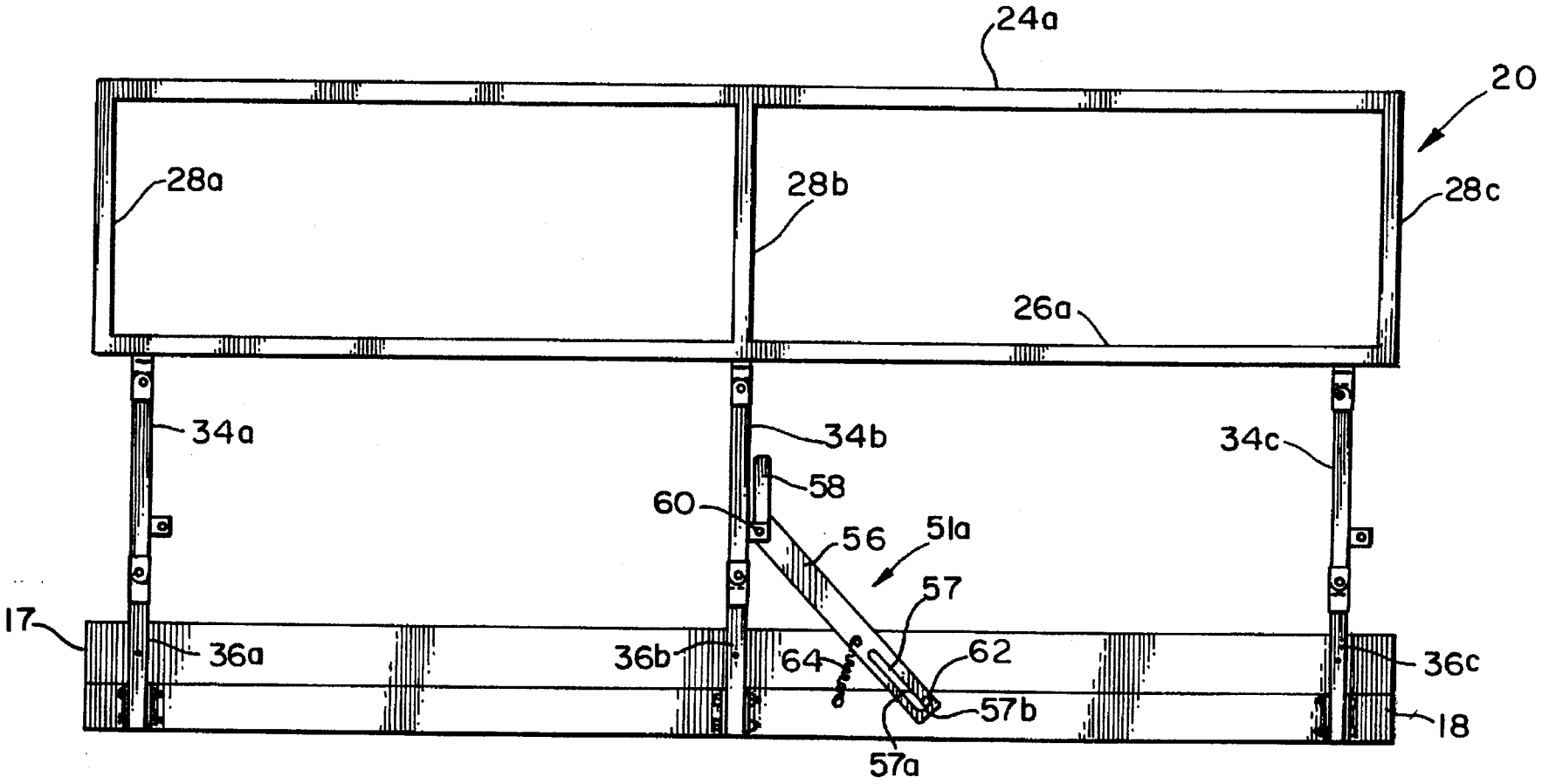
FIGS. 3*a* and 3*b* are side elevational views of the platform and railing assembly of FIG. 1 showing the adjustable rail assembly in respective elevated and lowered positions.
Figure 3B:
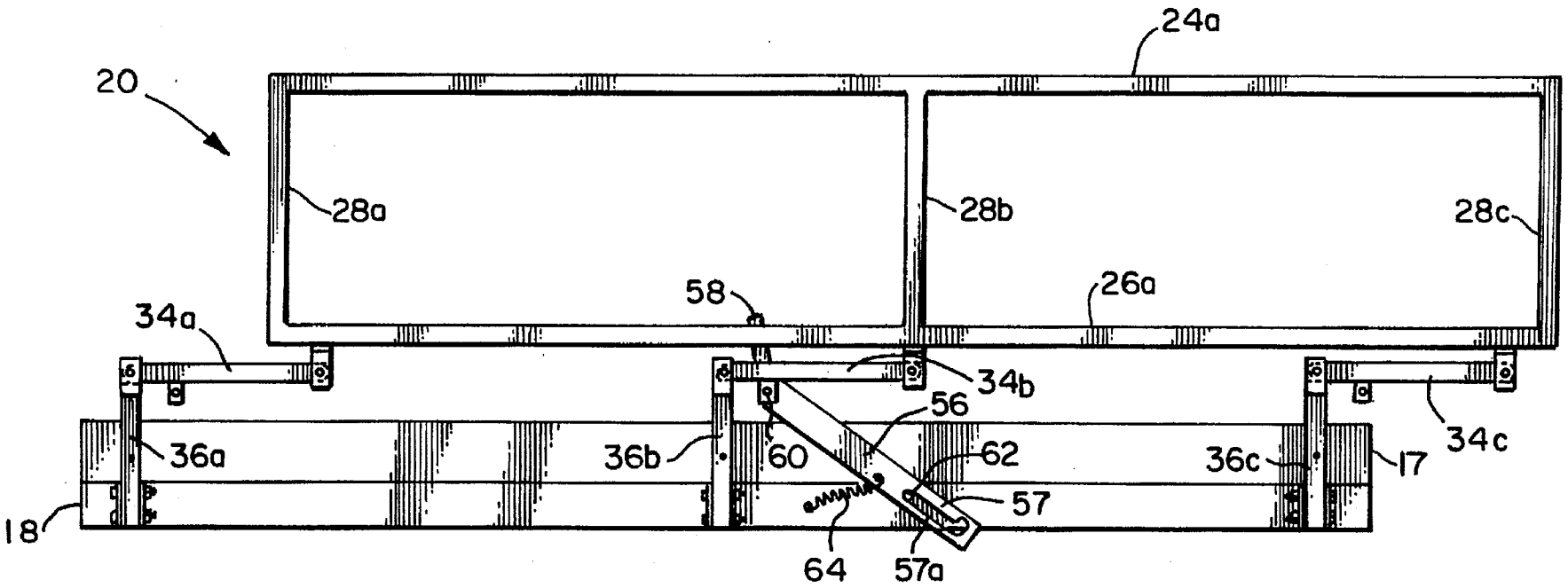

Turning now to FIGS. 3A and 3B, there is shown the preferred range of articulation between the railing assembly 20 and the platform 18, the link members connected therebetween providing the ability to elevate or lower the railing assembly 20 in order to reduce the height of the platform lifting machine. In FIG. 3A, the railing assembly 20 is shown in the elevated or raised position. In FIG. 3B, the railing assembly 20 is shown in its lowered position.

A latch assembly, generally designated 51*a*, is provided in order to lock the link 34*b*, so that the railing assembly 20 can be secured in its elevated position as shown in FIG. 3A. The latch assembly 51*a* includes a pivotal latch member 56. The latch member or latch 56 is secured at one end to a bracket 60 mounted upon the link 34*b* by a suitable pivot pin. The other end of the latch 56 is provided with a generally L-shaped slot 57 having a longitudinal portion 57*a* and a foot or transverse locking portion 57*b*. A locking member, such as guide pin 62, extends outward from the side of the platform 18 and is captured within the L-shaped slot 57. The locking member or guide pin 62 preferably has an enlarged head to capture the latch between the lead of the guide pin and the platform. A spring 64 is connected between latch 56 and the platform 18. When the railing assembly 20 is in its elevated position as shown in FIG. 3A, the spring 64 urges the locking pin 62 into the foot 57*b*of the slot to securely hold or lock the latch in fixed position. With the latch in fixed position under the urging of the spring 64, the link is locked in its vertical position to hold the railing assembly 20 fixed in its elevated position.

A handle or lever 58 is rigidly connected to the latch at 56 one end thereof, as shown in FIGS. 3A & 3B, to allow a person on the platform to easily pivot the latch 56 about the pivot point in bracket 60 to move the distal end of the latch against the bias the spring or locking portion 64, so that the pin can be freed from the foot 57*b* of the latch guide slot. With the locking pin 62 free of the locking portion of the latch, the railing assembly may be lowered as the locking pin travels in the longitudinal portion 57*a* of the L-shaped slot. The latch slides along guide pin 62 until the pin 62 hits the end of the longitudinal portion 57*a* of the slot, as shown in FIG. 3B. In this manner, the railing assembly is moved to its lowered position relative to the platform 18.

In order to raise the railing assembly 20 into the elevated position from the lowered position shown in FIG. 3B, the railing assembly 20 is lifted upward thus rotating the link 34*a–c* counter-clockwise into a vertical orientation. As the railing assembly is lifted, the latch 56 is guided into position by guide pin 62 within slot 57. When the railing assembly 20 has been lifted into the position shown in FIG. 3A, the bias exerted by spring 64 urges the latch to have transverse or foot portion 57*b*of the L-shaped slot capture the guide and locking pin 62, so that the railing assembly is latched and rigidly secured in its elevated position.

Referring again to FIG. 1, it can be seen that an additional latch assembly 51*b* is preferably employed with the link 34*e* on the opposite side of the platform to provide additional support and rigidity in holding the railing assembly in its elevated position. Furthermore, the additional latch assembly 51*b* maintains the railing assembly in the elevated position in the event that the latch assembly 51*a* is inadvertently moved so as to unlatch or unlock the latch assembly 51*a* while a person is working upon the platform. In embodiments having an additional latch assembly 51*b*, it should be appreciated that all of the latch assemblies are to be simultaneously actuated to a released condition of locking pin 62 in the foot or locking portion of the latch, when it desired to lower the railing assembly. One skilled in the art will also recognize that the railings on opposite sides of the platform could be raised independently and could be secured in elevated position by independent latch assemblies associated with each railing.

It should be appreciated that latch assembly of the present invention for locking the railing assembly in its elevated position can be embodied in a wide variety of forms to hold the links in upright or vertical position. In one possible alternative arrangement, the lever 58 may be attached to the brace 56 at a location other than that shown in FIGS. 3*a* and 3*b*. For example, the function provided by lever 58 may alternatively be provided by a handle or other suitable fixture attached along the length of latch 56 or at the opposite end of the latch, so that the latch 56 for manipulating the latch, as desired.

Figure 4A:
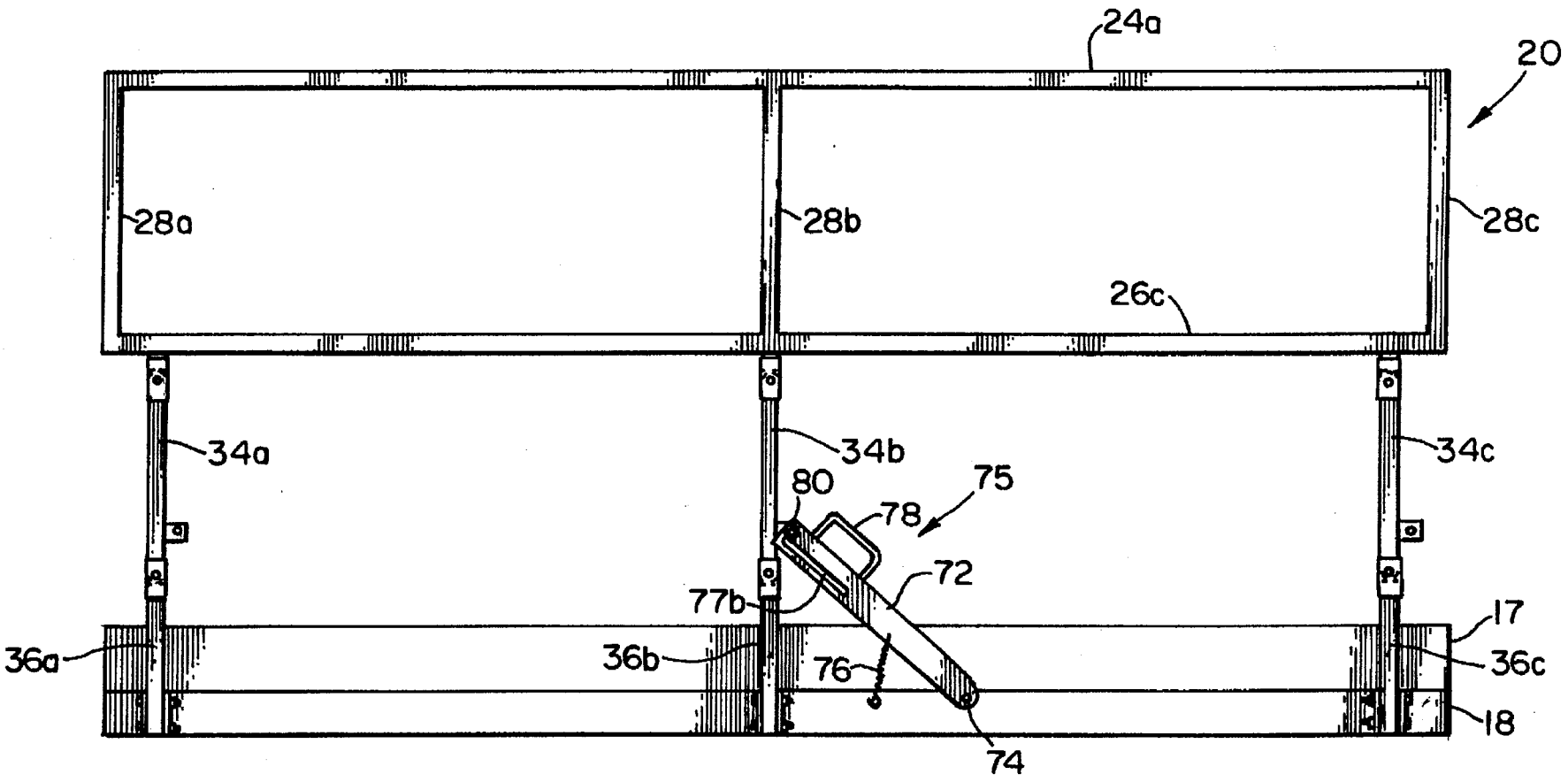
FIGS. 4*a* and 4*b* are side elevational views of an alternative embodiment of the latching arrangement between the platform and railing assembly of FIG. 1 and showing the railing assembly in respective elevated and lowered positions.
Figure 4B:
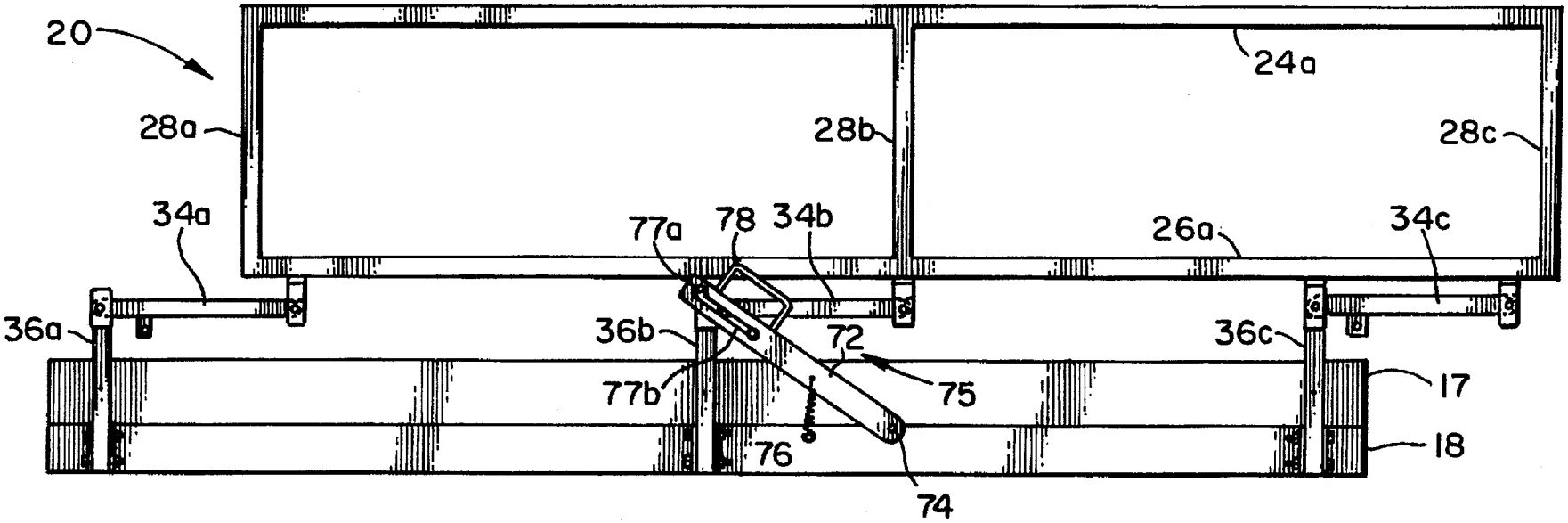

In FIGS. 4A and 4B, there is a further alternative embodiment for the latch assembly designated 75 therein. The latch assembly 75 in FIG. 4A includes a latch 72 that is pivotally connected at the lower end to the platform 18 by a pivot pin 74. The upper end of the latch 72 has an L-shaped slot formed therein. The L-shaped slot includes a longitudinal portion 77*b* and a transverse or foot portion 77*a*, which provides a locking portion when a guide pin 80, which is fixed to a bracket on link 34*b*, is captured therein. Hence, when the railing assembly 20 is in the elevated position, as shown in FIG. 4A, the guide or locking pin 80 is received in the foot or locking portion 77*a* of the L-shaped slot and is urged into such position by spring 76 connected between the latch 72 and the platform 18. A handle 78 is attached to the latch 72 for ease of movement of the latch. In order to lower the railing assembly 20, as shown in FIG. 4A, an operator merely raises the handle 78, exerting a force on the latch 72 counter to the bias of spring 76, in order to free the guide or locking pin 80 from the foot or locking portion of the L-shaped slot in the latch 72. The link 34*b* can then be rotated clockwise to move the railing assembly to its lowered position, as shown in FIG. 4B.

Figure 5:
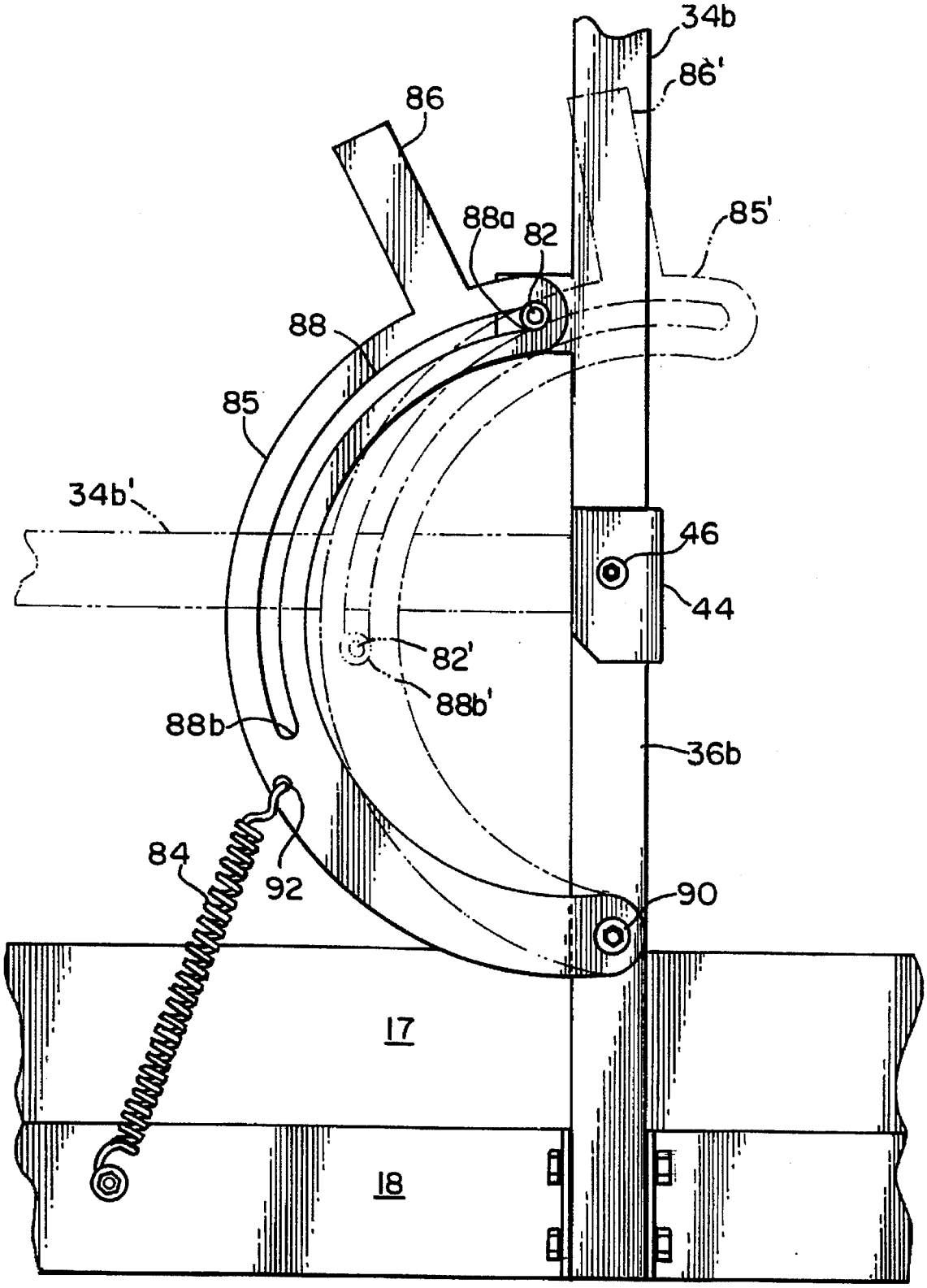
FIG. 5 is a side elevational view of another alternative latching arrangement between the platform and railing assembly.

A still further alternative embodiment for the latch arrangement is shown in FIG. 5. In the arrangement of FIG. 5, the link 34*b* is maintained in its vertical position by an arcuate shaped latch member 85. The link 34*b* carries a dual-purpose guide and locking pin 82, which is secured to a bracket on the link. The guide pin 82 is captured within a arcuate shaped guide slot 88 formed in the latch 85. The lower end of the arcuate latch 85 is attached to post 36*b*, which is rigidly secured to the platform 18.

When the link 34 between the railing assembly (not shown) is in the raised or vertical position, the guide or locking pin 82 is captured at the upper end 88*a* of the slot 88 in the latch 85. In this position, the arc of rotation for pin 82 to permit lowering of the link 34*b* is not coincident with the arc formed by slot 88 in latch 85, so that the slot of the latch forms a locking angle with the arc of rotation of the locking pin 82. Thus, the link 34*b* is prevented from rotating about the pivot 46 when the arcuate latch 85 is in the position shown in solid lines in FIG. 5. A spring 84 is connected between the platform 18 and the latch 85 in order to bias the latch 85 to maintain the latch 85 in its locking position with the pin 82 on link 34*b* to prevent rotation of the link.

As shown in FIG. 5, the upper end of post 34*b* carries a C-shaped bracket 44 attached by pivot pin 46. The bracket 44 is adapted to prevent clockwise movement of the link from its vertical position shown in FIG. 5, while permitting counterclockwise movement for lowering the railing assembly.

In order to move the railing assembly (not shown) to its lowered position, the latch 85 is moved by its handle 86 in a clockwise direction about pivot 90 against bias of spring 84 to the dotted line position shown in FIG. 5. As the latch is rotated in a counterclockwise direction, the locking pin 82 can be moved within the slot of the latch 85 to permit the link to rotate about pivot 90. As the handle 86 is moved into the position shown in phantom as 86', the brace 85 pivots into the position shown as 85' and the guide pin 82 is guided within the slot 88 until the guide pin 82 reaches the position 82' within the lower end 88*b*' of the slot. As the guide pin 82 is rotated into the dotted line position 82' indicated in FIG. 5, the link 34*b* rotates about pivot 46 to reach the position 34*b* shown in dotted lines to lower the railing assembly, as has been described in connection with the previous embodiments.

In the practice of the present invention, it is not necessary to have the upper and lower side rails of the railing assembly be connected as a unit to be raised and lowered together. For example, in FIG. 6, there is shown a platform lifting machine generally designated 110 having an alternative railing arrangement. In the embodiment shown in FIG. 6, the machine 110 has a platform 118 to which elongated vertical support members 136*a–c* are rigidly attached. A lower side rail 126 is welded or otherwise secured to the upper ends of the vertical members 136*a–c*. The lower side rail 126 has brackets 144*a–c* mounted thereon for pivotally securing the respective lower ends of link members 134*a–c* thereto. The upper ends of links 134*–c* are pivotally secured within respective brackets 140*a–c*, which are mounted along the lower surface of upper side rail 124.

Figure 6:
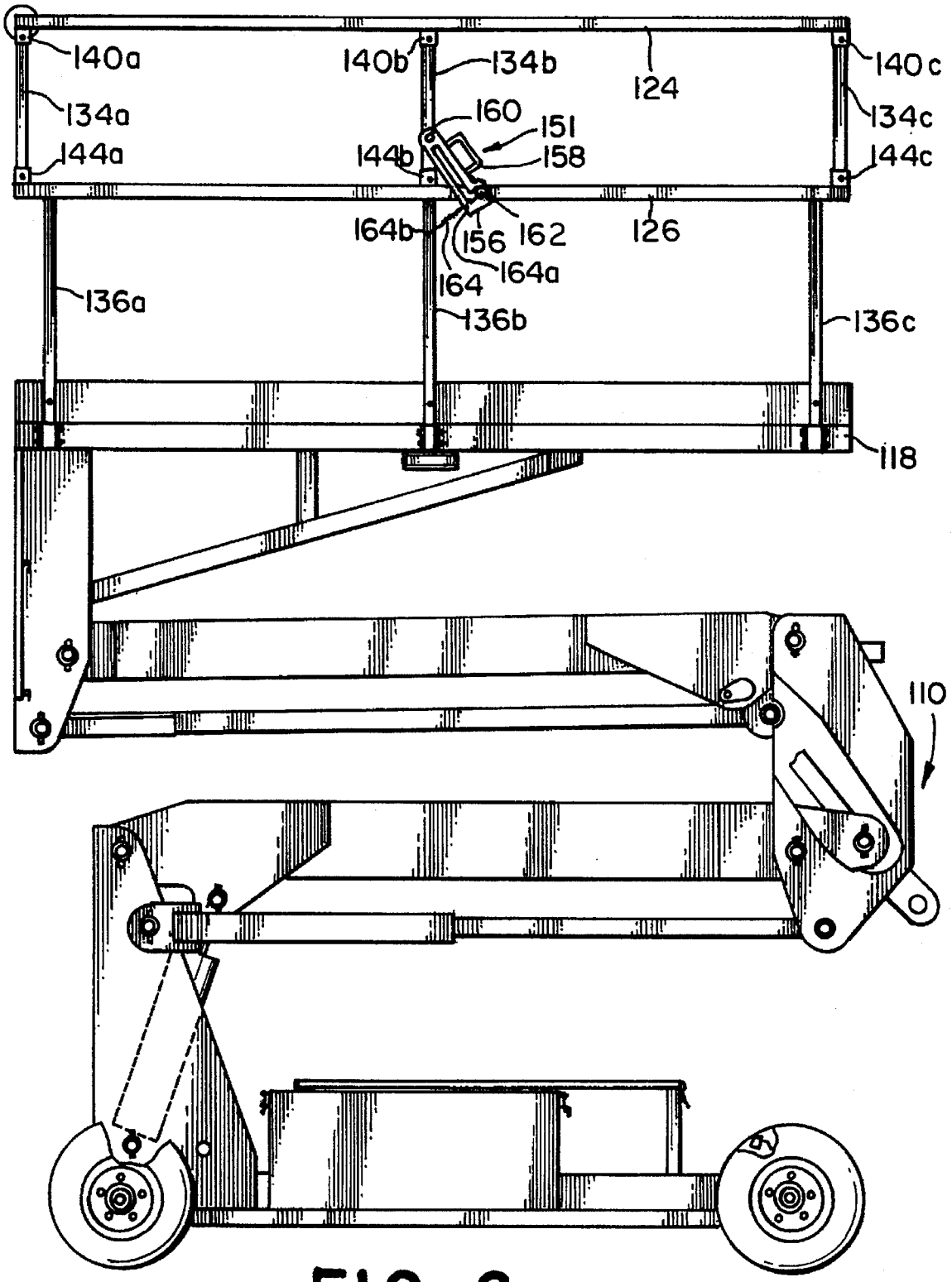
FIG. 6 is a side elevational view of a mobile platform lifting machine having an alternative adjustable railing configuration.

As can be appreciated, the upper side rail 124 in FIG. 6 can be lowered and/or raised relative to the platform 118 by movement of the links about their pivotal connections 144*a–c*. A latch assembly generally designated 151 is provided in order to selectively lock the links in their upright or vertical position, when the upper side rail is raised. The link assembly 151 has a pivoting latch 156 that is secured to the link **134*b* by a pivot 160. A guide or locking pin 162 is secured to the lower side rail 126. The guide pin 162 extends outwardly from the lower side rail 126 and is captured within L-shaped slot formed in the latch 156. The manner of operation of latch 151 in conjunction with links 134*a–c* is similar to that described in connection with the latch 56 of FIGS. 3*a* and 3*b*. Since the latch assembly 151 and the link arrangement in FIG. 6 are similar to corresponding parts in FIG. 3, the operation of the corresponding parts in FIG. 6** will not be described again.

The terms and expressions which have been employed are used as terms of description and not of limitation. It will be recognized by those skilled in the art that changes can be made to the above described embodiments without departing from the equivalence of the features shown and described, or inventive concepts expressed herein. It is understood, therefore, that this invention is not limited to the particular embodiments disclosed, but is intended to cover all modifications which are within the scope and spirit of the invention as defined in the appended claims.

That which is claimed is:

1. An apparatus, comprising:

a support base;

a horizontal platform for supporting a person standing thereon above the support base;

elevating means connected between the support base and the platform for positioning said platform at a desired elevation above the support base;

a railing assembly defining a periphery about the platform for confining the person supported on the platform;

a plurality of link members for supporting said railing assembly above said platform, each of said link members being pivotally connected at one end with said railing assembly and pivotally connected relative to said platform at the other end for allowing movement of said railing assembly to a position elevated above the platform from a relatively lower position; and latch means having a pivotal connection with one of said link members for preventing movement of said one link member when said railing assembly is positioned at the elevated position above said platform, whereby a person standing on the platform is inhibited from falling off of the platform, said latch means comprising a latch member connected to said pivotal connection having a slot formed therein, and a guide member positioned to slide along the slot during movement of the railing assembly.

2. The apparatus of claim 1 wherein said link members have a rectangular cross section and are each pivotally connected to the railing assembly by a pivot assembly, comprising:

an upper bracket member extending from the underside of the railing and formed with three sides to receive the associated link member; and an upper pivot member extending through the bracket member and through said one end of the link member;

whereby the link member is prevented from rotating within the upper bracket member beyond a position substantially perpendicular to the railing.

3. The apparatus of claim 2 comprising:

a lower bracket member connected at a fixed position relative to the platform and formed with three sides to receive said other end of the associated link member, the orientation of the lower bracket member being positioned in an opposing orientation relative to the upper bracket member; and a lower pivot member extending through the bracket member and through said other end of the link member;

whereby the link member is prevented from rotating within the lower bracket member beyond a position substantially perpendicular to the platform.

4. The apparatus of claim 1 wherein said latch means is configured for allowing said railing assembly to be lifted directly to the elevated position from the lower position and for automatically having the railing latched in place when the railing has been lifted to the elevated position.

5. The apparatus of claim 4 in which the platform structure includes a plurality of post members spaced along the perimeter of said platform, said post members having different ones of said link members pivotally attached thereto at one end of each link member.

6. The apparatus of claim 4 wherein the latch member comprises a longitudinal slot portion and a transverse slot portion, and wherein said latch means comprises a spring for biasing the transverse slot portion onto the guide member when the railing assembly is lifted to the elevated position.

7. An apparatus, comprising:

a support base;

a horizontal platform for supporting a person standing thereon above the support base;

elevating means connected between the support base and the platform for positioning said platform at a desired elevation above the support base;

a railing assembly comprising an upper railing and a lower railing for defining a periphery about the platform for confining the person supported on the platform;

a plurality of link members for supporting said upper railing above said platform, each of said link members being pivotally connected at one end with said upper railing and pivotally connected to said lower railing at the other end for allowing movement of said upper railing to a position elevated above the lower railing from a relatively lower position; and latch means having a pivotal connection with one of said link members for preventing movement of said one link member when said upper railing is positioned at the elevated position, whereby a person standing on the platform is inhibited from falling off of the platform;

wherein said latch means is configured for allowing said upper railing to be lifted directly to the elevated position from the lower position and for automatically having the upper railing latched in place when the upper railing has been lifted to the elevated position, and wherein said latch means comprises:

a latch member connected at one end to the one link member at said pivotal connection, said latch member having a slot formed therein comprising a longitudinal slot portion and a transverse slot portion;

a locking member extending from the lower railing and positioned within the slot formed in the latch member; and a spring for biasing the latch member against the locking member such that the transverse slot portion is biased toward the locking member when the upper railing is in the elevated position for latching the latch member.

8. The apparatus of claim 7 wherein the latch means comprises a handle connected with the latch member for exerting an opposing force against the bias of the spring for releasing said latch means to permit said upper railing to be lowered from the elevated position to the lower position.

9. The apparatus of claim 7 wherein said link members have a rectangular cross section and are each pivotally connected to the upper railing by a pivot assembly, comprising:

an upper bracket member extending from the underside of the upper railing and formed with three sides to receive the associated link member; and an upper pivot member extending through the bracket member and through said one end of the link member;

whereby the link member is prevented from rotating within the upper bracket member beyond a position substantially perpendicular to the upper railing.

10. The apparatus of claim 9 comprising:

a lower bracket member connected at a fixed position relative to the lower railing and formed with three sides to receive said other end of the associated link member, the orientation of the lower bracket member being positioned in an opposing orientation relative to the upper bracket member; and a lower pivot member extending through the bracket member and through said other end of the link member;

whereby the link member is prevented from rotating within the lower bracket member beyond a position substantially perpendicular to the lower railing.

* * * * *